United States Patent [19]

Kurek

[11] Patent Number: 4,850,281

[45] Date of Patent: Jul. 25, 1989

[54] TRACTION WHEEL TURN FOR POWER AND FREE CONVEYOR

[75] Inventor: Raymond H. Kurek, Kansas City, Mo.

[73] Assignee: Automatic Systems, Inc., Kansas City, Mo.

[21] Appl. No.: 190,588

[22] Filed: May 5, 1988

[51] Int. Cl.[4] ..... B61B 10/02

[52] U.S. Cl. ..... 104/94; 104/172.4

[58] Field of Search ..... 104/172.1, 172.4, 189, 104/191, 197, 89, 94, 91

[56] References Cited

U.S. PATENT DOCUMENTS

| | | | |
|---|---|---|---|
| 663,251 | 12/1900 | Barney | 104/172.4 X |
| 3,354,834 | 11/1967 | Orwin | 104/172.4 |
| 3,391,650 | 7/1968 | Goforth et al. | 104/191 X |
| 3,623,538 | 11/1971 | Wakabayashi et al. | 104/172.4 X |

FOREIGN PATENT DOCUMENTS

| | | | |
|---|---|---|---|
| 8400347 | 2/1984 | World Int. Prop. O. | 104/172.1 |

*Primary Examiner*—Robert B. Reeves
*Assistant Examiner*—Frank Williams
*Attorney, Agent, or Firm*—D. A. N. Chase

[57] ABSTRACT

A traction wheel turn for a power and free conveyor employs a single rotary unit to effect a complete, 180° reversal of the course of the conveyor. A circular track component forms a part of the free track at the inside of the turn and is carried by the traction wheel and rotates therewith. The inside wheels of the free trollies transfer from a standard, straight track section to the circular component at the turn, are carried thereby through the turn, and are delivered to the next stationary track section at the end of the turn. The horizontal space occupied by the turn is therefore, no greater than the diameter of the traction wheel.

8 Claims, 3 Drawing Sheets

TRACTION WHEEL TURN FOR POWER AND FREE CONVEYOR

This invention relates to improvements in tracks for power and free conveyors at locations along a run where a turn is required, and in particular to a traction wheel turn which enables the conveyor to reverse its course within a minimum horizontal space.

Power and free conveyor systems are often utilized in factory layouts requiring sharp turns in the course of the conveyor in minimum space. Conventional systems utilize a power track for power trolleys that are interconnected by the conveyor drive chain, and a separate, vertically-spaced free track for the free trolleys and associated load--bearing carriers. The conveyor chain is disposed between the two tracks and is not laterally supported in a straight run. Therefore, when a turn is encountered, the chain must be properly guided as the power and free trolleys traverse a curved course which will be defined by the track sections at the turn. Typically, a roller turn formed by a series of rollers rotatable on vertical axes is used to provide side support for the chain at the inside of a turn to thereby maintain the power trolleys and chain in a normal operational position throughout the course of the turn.

An example of a difficult manufacturing or processing environment requiring sharp turns including complete reversal of the course of a power and free conveyor in minimum space is the use of such conveyors in painting or drying ovens where it is desired that the products borne by the conveyor have maximum residence time within the oven enclosure. The high temperatures associated with these applications render roller turns unusable because the ball bearings in the rollers cannot tolerate the heat. Conventional traction wheels with heat-resistant sleeve bearings can be substituted, but with the disadvantage that a significantly greater horizontal space is required to execute 180° turns.

It is, therefore, the primary object of the present invention to provide a turn for a power and free conveyor, the turn being effected through the utilization of a single rotary unit that enables the conveyor to undergo sharp turns, including reversing its course, within a minimum space.

As a corollary to the foregoing object, it is an important aim of this invention to provide a turn for a power and free conveyor which utilizes a single traction wheel disposed between the power track and the free track in tractional engagement with the conveyor chain at the inside of the turn, in conjunction with a portion of the conveyor track which rotates with the traction wheel.

A further and important object of the invention is to provide a turn for a power and free conveyor as aforesaid which is capable of reversing the course of the conveyor without placing a long cantilever load on the free track and, in particular, to implement this objective by mounting the inside component of the free track on the traction wheel for rotation therewith.

DESCRIPTION OF THE PREFERRED EMBODIMENT

Figure 1:
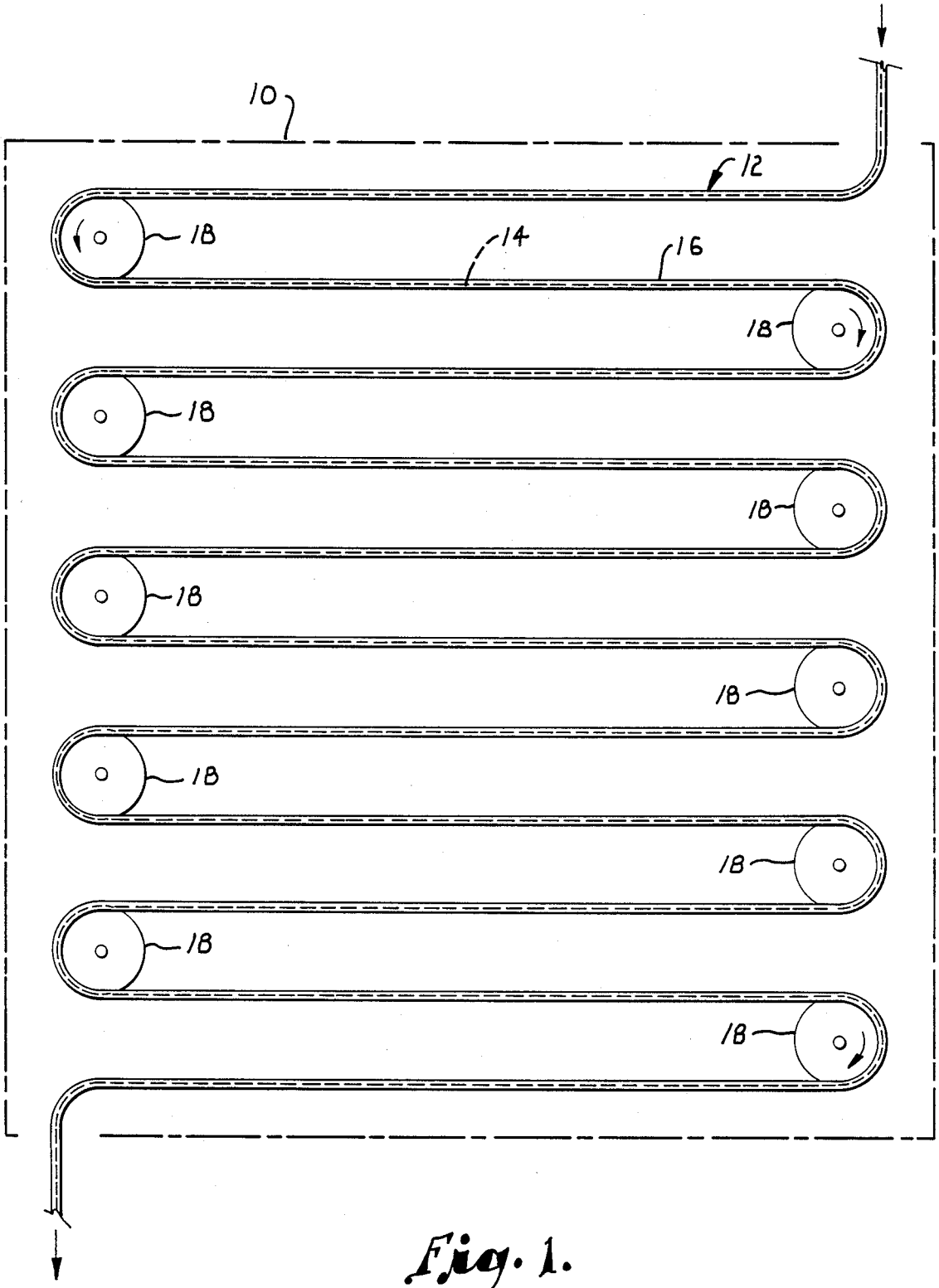
FIG. 1 is a diagrammatic, simplified plan view illustrating the traction wheel turns of the present invention as the conveyor traverses a drying oven in a serpentine path.

Referring initially to FIG. 1, a drying oven 10 is illustrated by the broken line enclosure and represents an application in which the present invention may be advantageously employed. A power and free conveyor broadly denoted 12 moves in the direction of the arrows into, through and out of the oven 10 within which the products carried by the conveyor are subjected to elevated temperatures. Typically, in a paint oven, temperatures on the order of 400° Fahrenheit are common and are above the temperature that can be tolerated by ball bearings and standard petroleum-based lubricants.

Note in FIG. 1 that the conveyor 12 traverses a serpentine path through the oven enclosure 10 in order to provide maximum residence time for the products being conveyed. This residence time is increased by the ability of the conveyor 12 to undergo many reversals of its course (180° turns), ten such reversals being illustrated. The diagrammatic illustration of FIG. 1 shows the conveyor chain 14 in broken lines beneath an I-beam power track 16, the chain 14 engaging successive traction wheels 18 defining each of the ten 180° turns in FIG. 1.

Figure 2:
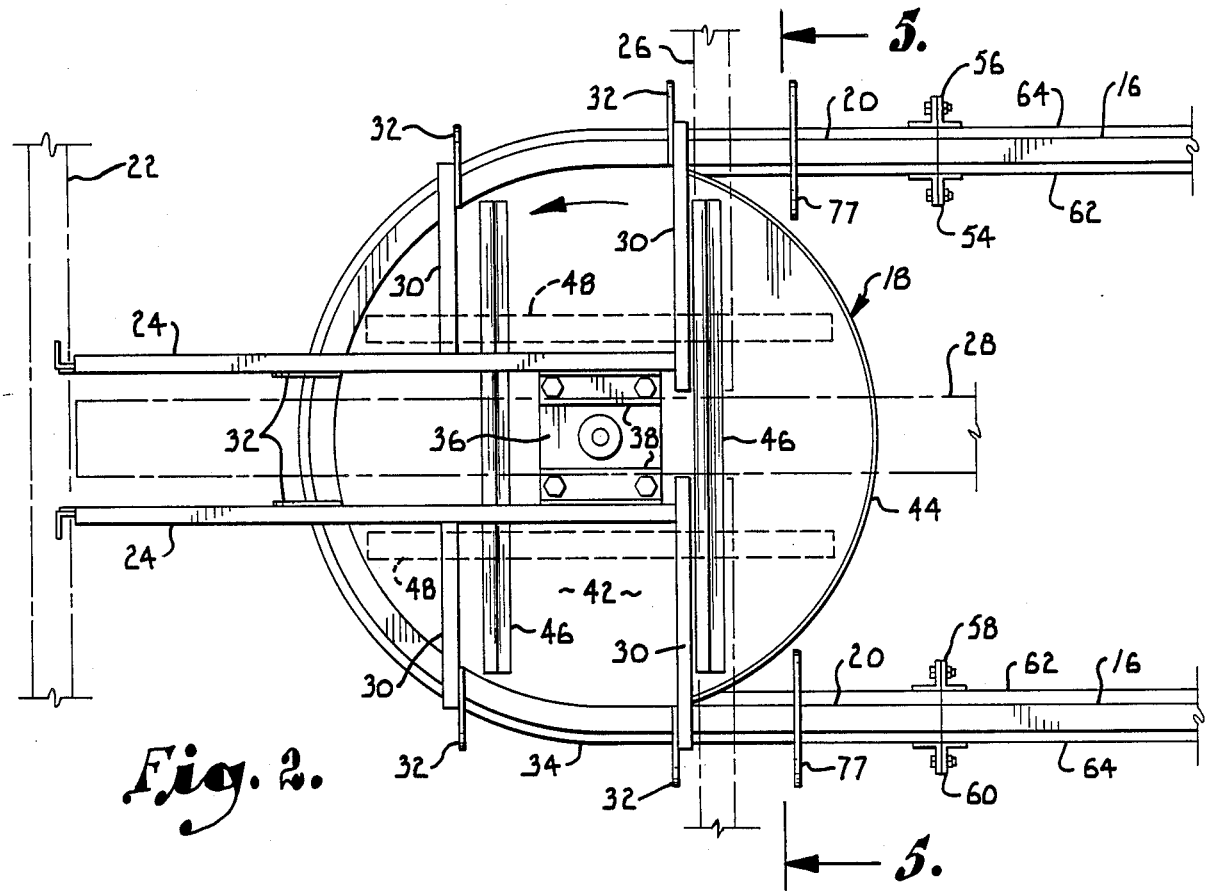
FIG. 2 is a plan view showing the traction wheel at one of the turns seen in FIG. 1, certain of the overhead supporting beams being revealed in phantom lines so that the underlying structure can be seen.
Figure 3:
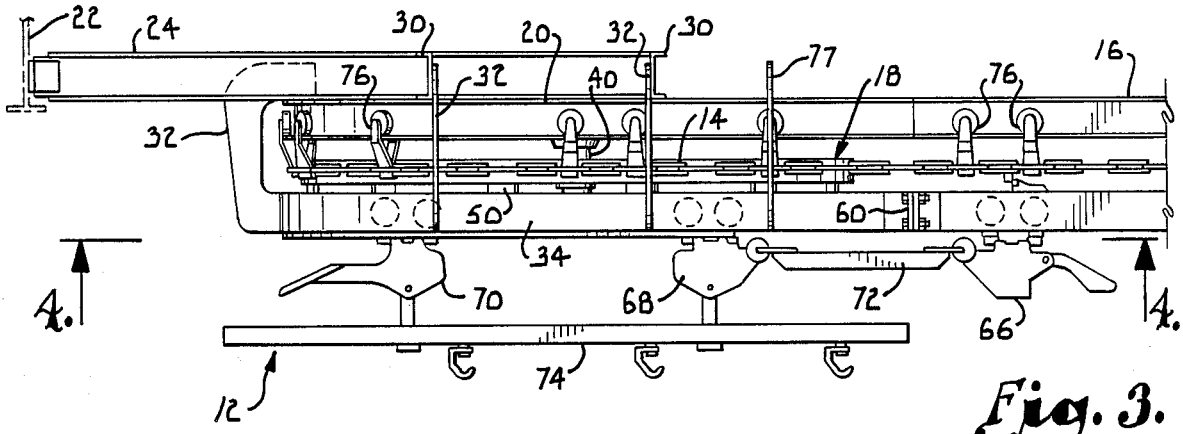
FIG. 3 is a front elevation of the structure shown in FIG. 2 with the components of a power and free conveyor added, and with certain support beams removed for clarity.

Referring particularly to FIGS. 2 and 3, one of the traction wheel turns depicted in FIG. 1 is shown in detail. The I-beam power track 16 extends to the turn at the upper right corner of FIG. 2 and leads away from the turn at the lower right corner of FIG. 2, counterclockwise rotation of the wheel 18 being indictaed by the arrow. In addition to the straight, standard track sections extending to and from the turn, the power track 16 is provided with an arcuate section 20 which includes a semicircular stretch defining the 180° turn.

Figure 5:
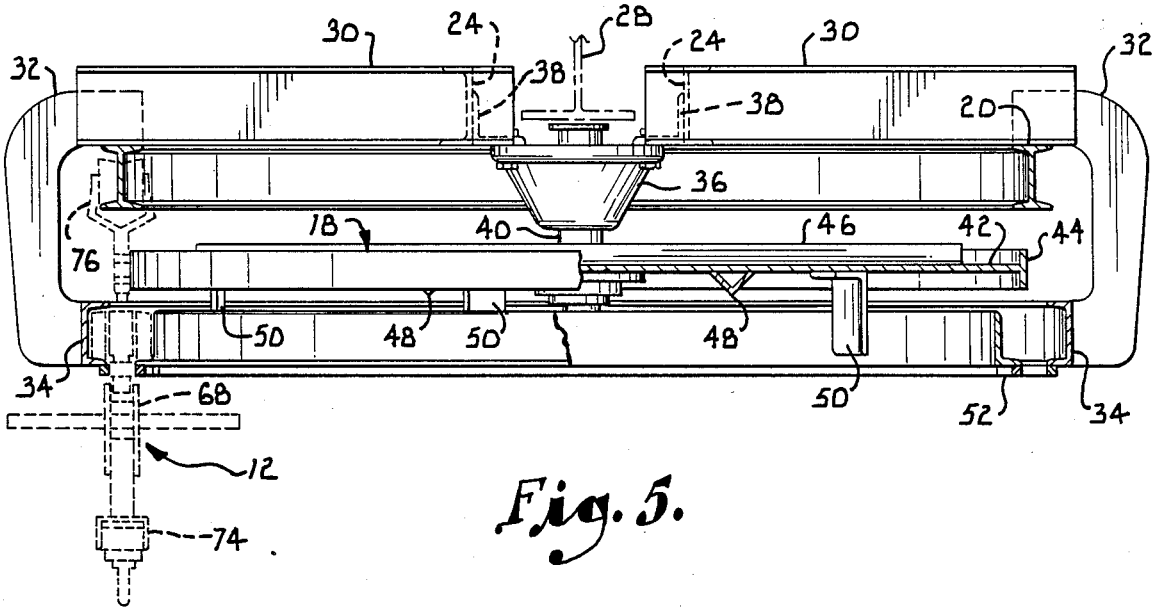
FIG. 5 is a vertical cross-setion on an enlarged scale taken along line 5—5 of FIG. 2, the conveyor being shown in broken lines at the left side of the drawing and parts being broken away to reveal the hangers which attach a circular free track component to the traction wheel.

A superstructure supports the track section 20 from above, and includes an I-beam 22 shown in phantom lines at the left of FIGS. 2 and 3, a pair of channel members 24 extending horizontally to the right from beam 22 over the track section 20, and additional horizontal support beams 26 (parallel to 22) and 28 (orthogonal to 22) shown in phantom lines in FIG. 2. The channel members 24 are joined to the track section 20 by four channel beams 30 extending at right angles thereto, and C-shaped suspension plates 32 depend from the outer ends of the beams 30 to complete the support for the turn assembly. As seen in FIG. 5, the C-shaped plates 32 and beams 30 are welded to the upper flange of the I-beam power track section 20 and extend downwardly where their lower, inner ends are welded to a stationary, arcuate, free track component 34 as will be subsequently described.

A hub assembly 36 establishes a vertical axis at the center of the turn about which the traction wheel 18 is freely rotatable. The hub assembly 36 is mounted between the channel members 24 by a pair of angle irons 38 and projects downwardly within the power track section 20 as is clean in FIG. 5. The traction wheel 18 is fixed to a vertical shaft 40 that depends from hub assembly 36, it being understood that the assembly 36 includes a sleeve bearing (not shown) for the shaft 40 of heat-resistant composition so that the wheel 18 is mounted for free rotation about the vertical, central axis of the turn unaffected by the oven environment. The wheel 18 includes a circular, horizontal plate 42 terminating in a continuous lip that presents a radially outwardly facing, circumferential surface 44. A pair of reinforcing angle members 46 overlie the circular plate 42, and are augmented by a pair of angle members 48 extending at right angles thereto on the underside of the plate 42.

Figure 4:
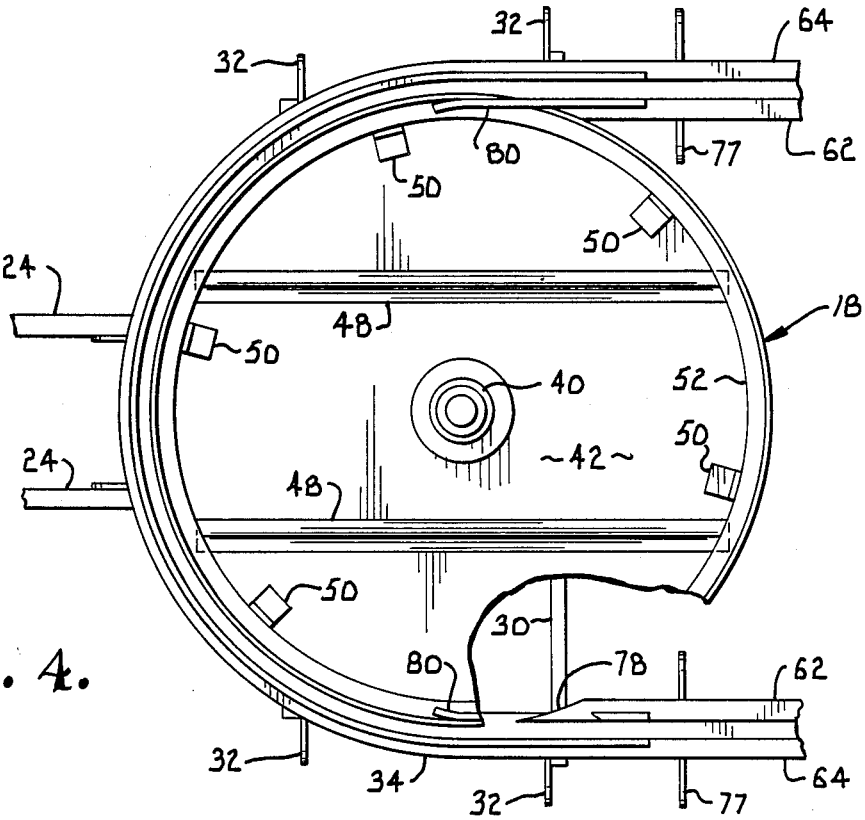
FIG. 4 is a slightly enlarged, bottom plan view taken along line 4—4 of FIG. 3, with the conveyor removed and parts broken away to reveal details of construction.

Six hangers 50 on the underside of plate 42 are equally spaced around the circular plate adjacents its circumferential edge, and are employed to attach a circular track component 52 (FIGS. 4 and 5) to the traction wheel 18 so that the wheel and the circular track component 52 rotate as a unit about the vertical axis defined by the hub assembly 36 and shaft 40. The circular component 52 and the arcuate component 34 comprise cooperating elements of an arcuate section of the free track of the power and free system, components 34 and 52 being joined to standard, straight sections of free track by inner and outer couplings 54 and 56 (FIG. 2) at the beginning of the turn, and inner and outer couplings 58 and 60 at the end of the turn. As is conventional in power and free conveyor systems of the type illustrated (see, for example, U.S. Pat. No. 4,635,558), each of the straight sections of free track is formed by opposed channel members 62 and 64 which define a compartment for rolling movement therealong of the wheels of free trollies such as illustrated at 66, 68 and 70 in FIG. 3.

A typical trolley train configurtion is illustrated in FIG. 3, where the leading free trolley 66 is shown connected by a tow bar 72 to the intermediate trolley 68, the latter and the trailing trolley 70 having a carrier bar 74 suspended therefrom to which products would be attached. A series of power trollies 76 are shown riding on the lower flange of the I-beam power track 16 and 20, and are interconnected at their lower ends by a flexible propelling member presented by the endless conveyor chain 14. As revealed by a comparison of FIGS. 3 and 5, the chain 14 bears against 180° of the circumferential surface 44 and thus tractionally engages and rotates the wheel 18. Simultaneously, since the circular free track component 52 is carried by the traction wheel 18, it likewise rotates and carries with it the wheels of the free trollies at the inside of the turn.

Conventional yoke plates 77 suspend the opposed channel members 62 and 64 of the free track beneath the power track 16 in the straight runs of the conveyor. At the turn, each of the suspension elements comprises a half yoke plate which presents the C-shaped suspension plates 32 seen in FIGS. 3 and 5. It should be appreciated that the free trolley support function of the inner channel member 62 of the free trolley track is asumed at the turn by the circular track component 52 carried by the traction wheel 18. The crosssectional configuration of the circular component 52 is essentially L-shaped rather than channel-shaped, but provides the necessary lower flange facing the corresponding lower flange of the arcuate channel component 34 in order to provide the necessary horizontal supporting surface for the wheels of the free trollies at the inside of the turn. The transition from the straight, inner channel member 52 to the circular track component 52, and vice versa, is facilitated by tapering the terminal end of the channel member 62 as shown at 78 in FIG. 4, and providing an underlying supplemental guide bar 80 at the beginning and the end of the turn to support the inner trolley wheels in the small gap between the straight track termination and the continuous circular track component 52.

From the foregoing, it may be appreciated that the continuous, circular free track component 52 carried by and rotatable with the traction wheel 18 provides a turn construction for power and free conveyors requiring only a single traction wheel to effect a complete reversal of the course of the conveyor. Being supported by the traction wheel itself, no interfering supporting structure beneth the turn is required nor is a cantilever load placed on the free track. The result is that a turn can be effected in a horizontal space equal to the diameter of the single traction wheel.

Having thus described the invention, what is claimed as new and desired to be secured by Letters Patent is:

1. In a power and free conveyor:

a power track having an arcuate section therein defining a turn, a free track spaced from said power track and having a circular component aligned with said arcuate section of the power track at said turn, said power track being adapted to support a series of power trolleys interconnected by a flexible propelling member extending along and between said tracks, and said free track being adapted to support free trolleys and associated load-bearing carriers, a traction wheel between said tracks having a radially outwardly facing, circumferential surface, means rotatably mounting said wheel at said turn with said surface aligned with said arcuate section and said circular component for tractional engagement by said propelling member, and means mounting said circular component on said wheel for rotation therewith.

2. The combination as claimed in claim 1, wherein said free track has an arcuate section comprising said circular component and a stationary, arcuate component cooperating therewith for supporting said free trolleys in said turn.

3. The combination as claimed in claim 2, wherein said circular component and said stationary component of the free track extend along said turn at the insdie and the outside thereof respectively.

4. The combination as claimed in claim 3, wherein said components comprise opposed channel members adapted to receive and support corresponding wheels of free trolleys.

5. The combination as claimed in claim 3, wherein said power and free tracks are vertically spaced, and wherein said means mounting the traction wheel disposes the same for rotation about an upright axis.

6. The combination as claimed in claim 5, further comprising support means extending from said power track section to said stationary component of the free track section for mounting the same in fixed, vertically spaced relationship with said power track section.

7. The combination as claimed in claim 5, further comprising support structure on said power track section, and wherein said means mounting the traction wheel includes hub means carried by said structure and defining said axis.

8. The combination as claimed in claim 7, further comprising support means extending from said power track section to said stationary component of the free track section for mounting the same in fixed, vertically spaced relationship with said power track section.

* * * * *

UNITED STATES PATENT AND TRADEMARK OFFICE

CERTIFICATE OF CORRECTION

PATENT NO. : 4,850,281

DATED : July 25, 1989

INVENTOR(S) : RAYMOND H. KUREK

It is certified that error appears in the above—identified patent and that said Letters Patent is hereby corrected as shown below:

Column 4, (Claim 3), line 44, delete "insdie" and insert --inside--.

Signed and Sealed this

Twenty-fourth Day of July, 1990

*Attest:*

HARRY F. MANBECK, JR.

*Attesting Officer*

*Commissioner of Patents and Trademarks*